US010676873B2

(12) United States Patent
Ganz

(10) Patent No.: US 10,676,873 B2
(45) Date of Patent: Jun. 9, 2020

(54) RAILROAD RENEWAL METHOD AND DEVICE FOR IMPLEMENTING SAID METHOD

(71) Applicant: MATISA MATERIEL INDUSTRIEL S.A., Crissier (CH)

(72) Inventor: Joerg Ganz, Etoy (CH)

(73) Assignee: MATISA Materiel Industriel S.A., Crissier (CH)

( * ) Notice: Subject to any disclaimer, the term of this patent is extended or adjusted under 35 U.S.C. 154(b) by 311 days.

(21) Appl. No.: 15/748,056

(22) PCT Filed: Jul. 26, 2016

(86) PCT No.: PCT/IB2016/054438

§ 371 (c)(1),
(2) Date: Jan. 26, 2018

(87) PCT Pub. No.: WO2017/017600

PCT Pub. Date: Feb. 2, 2017

(65) Prior Publication Data

US 2018/0216299 A1 Aug. 2, 2018

(30) Foreign Application Priority Data

Jul. 27, 2015 (FR) ..... 15 57163

(51) Int. Cl.
*E01B 29/44* (2006.01)
*E01B 29/17* (2006.01)

(52) U.S. Cl.
CPC ..... *E01B 29/44* (2013.01); *E01B 29/17* (2013.01)

(58) Field of Classification Search
CPC ..... E01B 11/46; E01B 29/17; E01B 29/42; E01B 29/44; E01B 29/46; E01B 31/18
See application file for complete search history.

(56) References Cited

U.S. PATENT DOCUMENTS 3,566,796 A * 3/1971 Herrick ..... E01B 31/18 104/2
5,237,143 A * 8/1993 Scheuchzer ..... E01B 31/18 104/15
2012/0012026 A1* 1/2012 Ganz ..... E01B 29/06 104/9

(Continued)

FOREIGN PATENT DOCUMENTS

EP 0467833 A1 1/1992
JP 2004188455 A 7/2004

(Continued)

*Primary Examiner* — Jason C Smith
(74) *Attorney, Agent, or Firm* — Laurence A. Greenberg; Werner H. Stemer; Ralph E. Locher

(57) ABSTRACT

A railroad renewal method includes, in particular: the removal of the old rail, the installation of the new rail and the primary adjustment of the temperature of the new rail to a set value at a point located upstream of and close to the attachment area on a crosstie. The thermodynamic behavior of the intermediate section of the new rail located between the primary temperature adjustment point and the attachment area is controlled by way of a device, provided with a control and management system, such that the temperature of the new rail is uniform, in the cross-section thereof, at a set value on the attachment point.

18 Claims, 4 Drawing Sheets

(56) References Cited

U.S. PATENT DOCUMENTS

| | | | | |
|---|---|---|---|---|
| 2014/0231532 | A1* | 8/2014 | Jury | B23K 11/04<br>238/164 |
| 2016/0194836 | A1* | 7/2016 | Ganz | E01B 27/105<br>104/9 |
| 2017/0030023 | A1* | 2/2017 | Lopez Bueno | E01B 29/13 |
| 2018/0216299 | A1* | 8/2018 | Ganz | E01B 29/44 |
| 2019/0032282 | A1* | 1/2019 | Ganz | E01B 27/16 |
| 2019/0352855 | A1* | 11/2019 | Ganz | E01B 27/04 |

FOREIGN PATENT DOCUMENTS

| | | | |
|---|---|---|---|
| WO | 9606981 | A1 | 3/1996 |
| WO | 2007118977 | A2 | 10/2007 |
| WO | 2014080118 | A1 | 5/2014 |

* cited by examiner

RAILROAD RENEWAL METHOD AND DEVICE FOR IMPLEMENTING SAID METHOD

BACKGROUND OF THE INVENTION

Field of the Invention

The invention relates to a railroad renewal method and a device for implementing said method.

More specifically, the invention concerns an improvement to methods implemented continuously for maintaining and/or renewing railroad tracks.

DISCLOSURE OF THE INVENTION

Work on railroad track renewal sites is generally carried out using special trains referred to as "work" trains for replacing, in full or in part, old or worn rails, which may or may not involve changing the crossties.

The old rail is removed immediately prior to the installation of the sections of new rail (on the old or new crossties), which may be up to several hundred meters long.

However, when permanently attaching the new rail to the crossties by means of rail fasteners, it is necessary to take into account the inevitable future modifications in the dimensions of the rail and, in particular, the fact that it will lengthen by expansion or retract as a result of the many major changes in temperature that will occur over time.

For this reason, in practice, the rail is attached after having previously adjusted its temperature to stabilize it at a predetermined value at a primary adjustment point located upstream from and close to the attachment area where it is attached to the crossties.

More specifically, this temperature, referred to as a "pre-destressing" or "destressing" temperature, is a temperature commonly accepted as the average value in the normal and predictable temperature range in the climate of the region where the rail is to be renewed.

These temperatures for "destressing" the rail can result from either heating or cooling relative to the ambient temperature at the track renewal site at the time that the new rails are being attached.

The "pre-destressing" temperature results from approaching the precise set temperature and therefore generally corresponds to a temperature range in the vicinity of the "destressing" temperature.

This operation for "pre-destressing" or "destressing" the rail makes it possible to anticipate its expansion or contraction, regardless of the ambient temperature at the site, and to thus limit the risk of subsequent slewing or breakage of the rail.

The heat input that makes it possible to reach and maintain this temperature is obtained, for example, by induction means that heat the rail locally in a continuous manner, close to and upstream from the attachment station where additional means for controlling and regulating the temperature are positioned, optionally coupled to the heating means.

Such a renewal method and the associated equipment, in particular the means for heating the rail, are already described, in particular, in WO 2007/118977, which is cited here as the technological background of the invention.

However, although the metal rail itself is able to provide good thermal conduction between the heat source and the attachment station where the temperature is measured and adjusted at the surface, it is necessary to ensure, in a reliable manner, that the temperature at the core of the rail and, in particular, at the center of the head or the flange, also corresponds, in a uniform manner, to the "pre-destressing" or "destressing" temperature.

For this purpose, laboratory tests have been carried out with sensors positioned at the center of the (steel) material of the rail. The results of these tests make it possible to calculate, in a sufficiently reliable manner, the time required, depending on the heat or cooling supplied, to obtain a uniform temperature through the whole cross section of the rail within a range of values referred to as the "pre-destressing" range or maintained at the precise "destressing" value at the time when the rail is attached.

Moreover, due to the dimensions of the equipment and the size of the "work" train wagons, the distance between the position of the heating station and the attachment station (10 to 20 meters) is sufficiently long for significant heat losses to occur and/or for the environment or collateral factors to have an unfavorable influence on the set temperature of the rail when it is being attached. This is the case, in particular, when the "work" train is stationary or moving slowly, or indeed when environmental events occur at the track renewal site (precipitation such as rain or snow, or the presence of wind, etc.) that are likely to affect the temperature of the rail. In these conditions, because the temperature of the new rail can vary, its length will be substantially modified at the time that it is permanently attached to the crosstie.

Therefore, disadvantageously, these factors are likely to subsequently result in uncontrolled inconsistencies in the internal stress of the rail that can prove to be seriously detrimental to the reliability and safety of the track, once the rail has been secured to the crossties.

Moreover, certain "work" trains are not able to reverse in order to correct, using the primary adjustment means, a discrepancy between the actual and set temperatures, for example, following an unexpected stoppage of the train. These "work" trains therefore need to adjust or maintain the set temperature during continuous operation directly and immediately before the time of attachment of the new rail.

BRIEF SUMMARY OF THE INVENTION

The invention aims to overcome these technical problems by ensuring that the thermodynamic behavior of the rail is controlled and its temperature more accurately adjusted at the point of attachment to the crossties.

This aim is achieved by means of a method characterized in that it involves controlling the thermodynamic behavior of the intermediate section of the new rail located between its primary temperature adjustment point and the attachment area, such that the temperature of the new rail is uniform, in the cross-section thereof, at a set value at the attachment point.

According to a first advantageous variant, the intermediate section is thermodynamically controlled by thermally insulating it from the external environment.

Preferably, the intermediate section is insulated by means of at least one thermally insulated tunnel.

According to a specific variant, the primary temperature adjustment is carried out by maintaining a temperature higher than the set value.

According to another variant, an additional thermal treatment is carried out along the intermediate section to compensate for thermal interactions with the environment.

According to an advantageous feature, the temperature of the intermediate section is measured continuously over all or part of its length by means of at least one sensor coupled to a computer acting on the primary adjustment and/or on the additional thermal treatment.

According to a specific variant, the additional thermal treatment is carried out by means of a thermodynamic fluid (gas or liquid).

According to an advantageous feature of this variant, the thermodynamic fluid is brought, under pressure, into contact with the rail, for example, by spraying it against the side faces of the latter.

According to another advantageous feature of this variant, the thermodynamic fluid is a heat-transfer fluid sprayed against the faces of the rail.

According to yet another variant of the method, the additional thermal treatment is carried out by means of a flame that comes into contact with the intermediate section of the rail.

According to yet another variant, the additional thermal treatment is carried out by means of at least one induction system, or indeed by combining at least two of the above-mentioned variants.

Preferably, the primary temperature adjustment of the intermediate section is carried out by heating by means of at least one induction system.

The invention also concerns a device for implementing the method as defined above.

According to an advantageous feature, this device is characterized in that it comprises a system for controlling and managing the thermodynamic energy of the intermediate section of the new rail situated between said primary adjustment means and the attachment area, said system being intended to make the temperature of the new rail uniform at a set value at the attachment point.

According to another feature, the control and management system comprises means for additional thermal treatment along said section for compensating for interactions with the external environment.

According to a first variant, the system comprises at least one temperature sensor arranged on the intermediate section, that is coupled to a computer acting on the primary adjustment means and/or on the means for additional thermal treatment.

Preferably, the control and management system comprises three temperature sensors arranged, respectively, at the primary adjustment means, along the section and at the attachment area.

According to another variant, the means for additional thermal treatment of the intermediate section comprise at least one thermally insulated tunnel.

According to yet another variant of the device, the means for additional thermal treatment of the section comprise a heating member that functions according to one or more modes chosen from induction heating, heating by heat-transfer fluid or heating by contact with a flame.

According to an alternative variant, the means for additional thermal treatment of the section comprise a cooling member.

The different variants of the method of the invention make it possible to improve the renewal of the railroad by positioning the new rails in a more reliable manner and attaching them appropriately to the crossties, while improving the preparation and adaptation of the track for potential variations in the dimensions of the rails resulting from environmental changes and, in particular, different climatic and/or meteorological conditions.

BRIEF DESCRIPTION OF THE FIGURES

Other features and advantages of the invention will become clearer upon reading the description that follows, with reference to the appended drawings described in detail below.

For the purpose of clarity, elements that are identical or similar are denoted by identical reference signs in all the figures.

DETAILED DESCRIPTION OF EMBODIMENTS

Naturally, the embodiments shown in the figures described above are provided purely as non-limiting examples. It is explicitly expected that these different embodiments and variants may be combined in order to propose others.

Figure 1A:
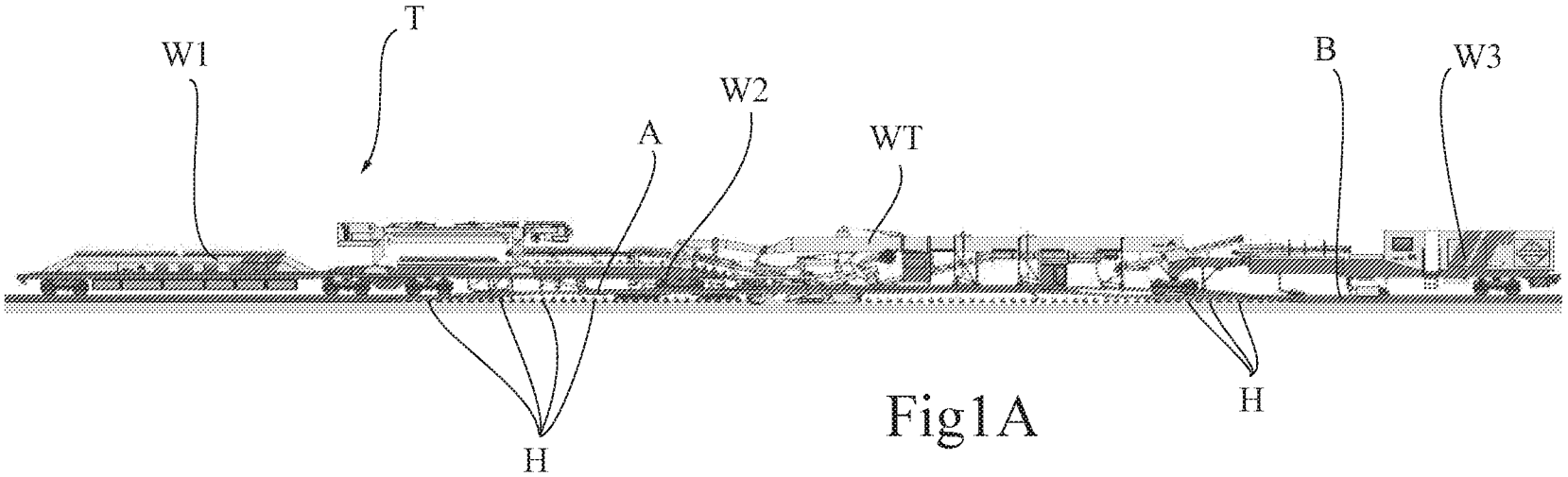
FIG. 1A shows a schematic view of a railroad track renewal site according to the prior art.

FIG. 1A shows an overall view of a conventional railroad track renewal site in which a work train T (shown in part) is used, respectively, for removing the old rails A (front sector) and laying new rails B on the crossties H (rear sector).

For the purpose of clarity, it is assumed in this case that the crossties H and the ballast (not shown in the figures) are not replaced.

The new rail B is laid and then gradually attached to the crossties H as the train moves forward, as shown in FIG. 1.

The front wagons W1 and W2 always run on the old rail A whereas the rear wagons W3 run on the new rail B. The central transport wagon WT that replaces the rails conventionally comprises mechanical means for lifting and supporting the rails and has a raised frame that makes no rolling contact with the track (FIG. 1).

In order to prevent or limit the risk of gaps or breakages in the track likely to be caused by variations in the dimensions of the rails as a result of more severe climatic or meteorological conditions, the metal profile sections of new rails are conventionally brought to an average temperature referred to as a "pre-destressing" or "destressing" temperature in order to be permanently attached to the crossties, said temperature causing the rail to extend or retract by a determined amount.

More specifically, the aim of these operations is to anticipate and simulate the mechanical behaviors of the constituent material of the rail depending on the temperature variations that can occur during its service life.

To this end, prior to laying, the section of new rail is subjected to a primary temperature adjustment to a set value T1 at a point C located upstream from and close to the attachment area F where it is attached to one or more crossties H.

This adjustment can consist of locally heating or cooling the metal, which is initially at the temperature T0, because the period of intervention on the track renewal site is chosen, preferably, at a time when the ambient temperature is lower or respectively higher than the set temperature referred to as the "pre-destressing" or "destressing" temperature.

Figure 1B:
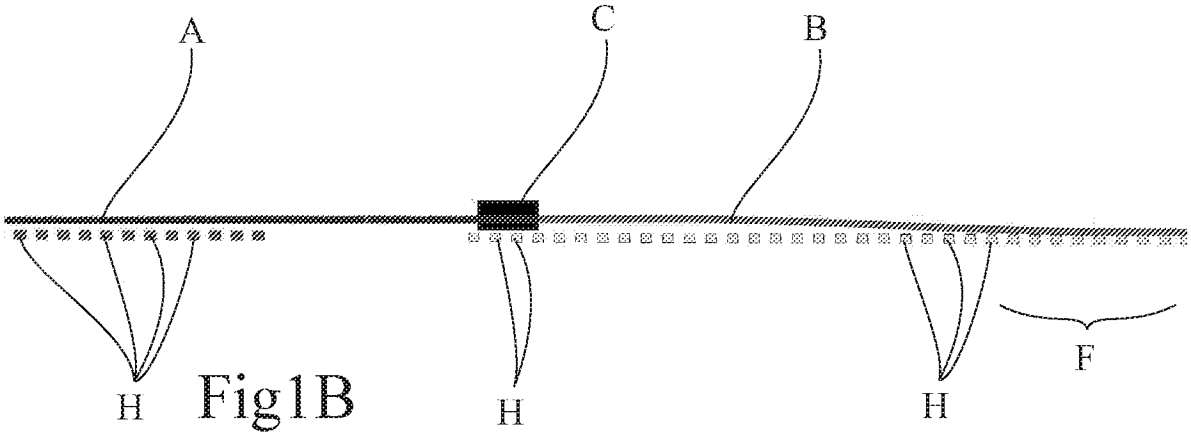
FIG. 1B shows a schematic view of a detail of the site of FIG. 1A.

When a heat input is required, this is carried out using heating means that consist, for example, of a thermal source or an induction system working upstream from the section R of the rail B on the crossties H (see FIG. 1B). This thermal input to the rail B is transmitted, by conduction through the metal, to the attachment area F of the rail B.

Conversely, if the thermal adjustment of the rail needs it to be locally cooled, suitable air conditioning or ventilation means can be used.

The subsequent retraction or lengthening of the rail caused, respectively, by its possible cooling down or heating up after being permanently fixed (depending on the ambient temperature) is then managed by applying assembly standards and observing possible clearances imposed by the regulations in force.

As shown in FIG. 1B, the section of the rail B located between the primary thermal adjustment (heating or cooling) station C and the attachment station F, is generally in the open air and is therefore subject to interactions with the climatic environment that are likely to give rise to variations in the dimensions of the rail before it is permanently attached to the crossties H.

In order to solve this problem, the method of the invention involves carrying out an additional thermal treatment CC with a view to correcting or maintaining the temperature of the rail B on this intermediate section R at a uniform set temperature value Tf (the temperature referred to as the "pre-destressing" or "destressing" temperature), regardless of the length of this section and external influencing factors.

To this end, the method is likely to be implemented according to various passive treatment variants, consisting of thermally insulating this section, and/or active treatment variants, consisting of compensating for natural decreases or increases in temperature as well as those caused by external agents (wind, rain, sun, etc.).

Figure 2:
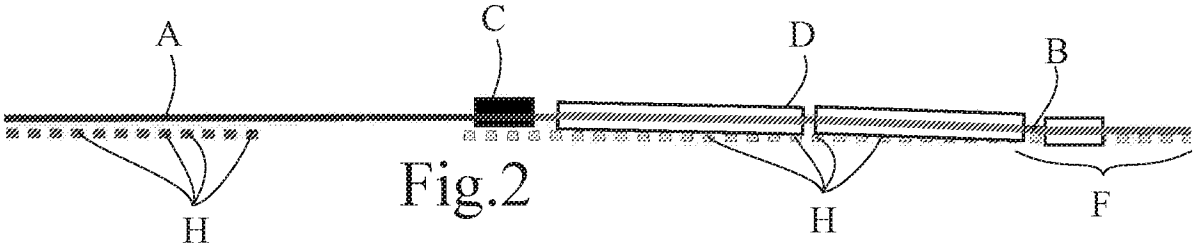
FIG. 2 shows a schematic view of a railroad track renewal site according to one mode of implementation of the method of the invention.

FIG. 2 shows a first passive mode of implementation of the method of the invention in which the section R of the rail B, pre-heated to the temperature T1 by the induction means C, is then inserted into at least one thermally insulated tunnel D that protects it and thermally insulates it from the outside.

In this tunnel, which extends in a continuous or discontinuous manner to the attachment area F, the temperature of the rail B remains stable around a value very close to the pre-destressing or destressing temperature Tf.

Figure 3A:
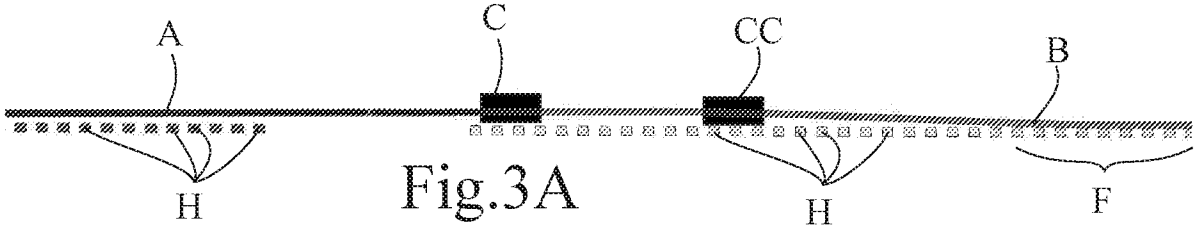
FIGS. 3A, 3B and 3C show schematic views of details of different embodiments of the device used to implement the method of the invention.
Figure 3B:
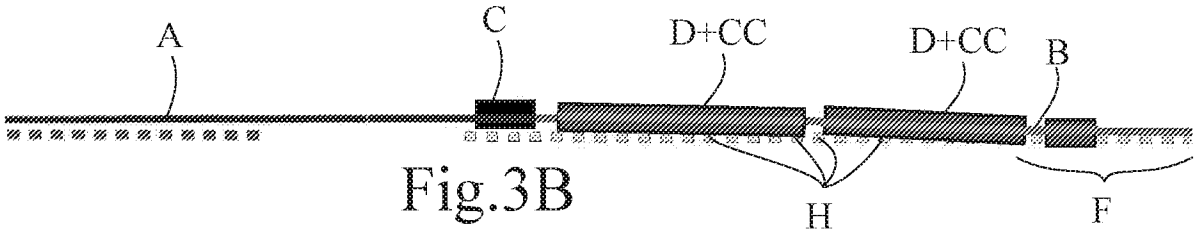
Figure 3C:
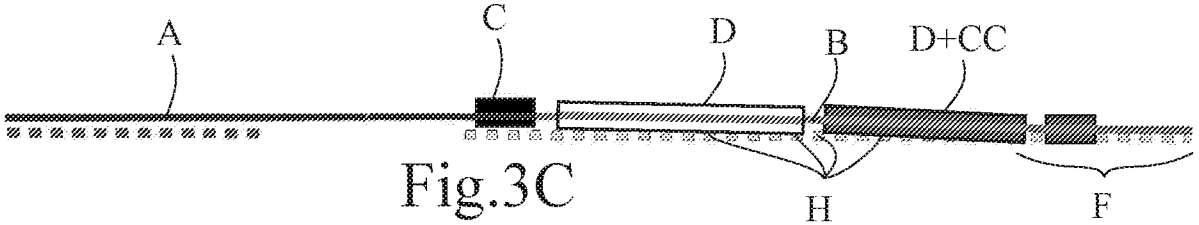

FIGS. 3A to 3B show active variants of implementation in which an additional quantity of heating or cooling energy is supplied to the rail B in order to compensate for the thermal losses along the length of the section R.

This thermodynamic modification (heat input or reduction) allows the rail B to therefore stay at a temperature equal or very close to the pre-destressing or destressing temperature Tf until it reaches the area F.

The primary temperature adjustment C is carried out by contributing a temperature greater than or less than the set value Tf in order to compensate for the time that passes between the thermodynamic input and the attachment F of the rail.

In the case of an addition of heating energy, this is delivered by heating means CC identical or similar to the primary heating means C arranged upstream.

The means CC therefore make it possible to maintain or correct the temperature of the intermediate section R of the new rail B before the attachment area F.

According to the invention, it is possible to combine these variants with that of FIG. 2 by providing additional heating means CC inside the thermally insulated tunnel D.

Figure 4:
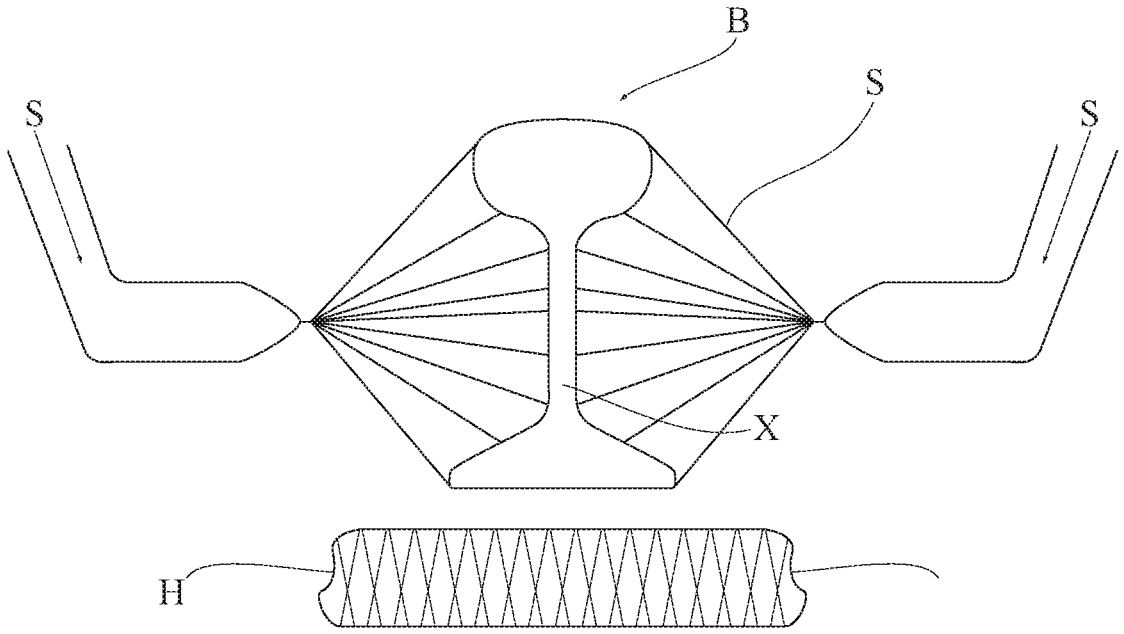
FIG. 4 shows a schematic view, in cross section, of a variant of the device for implementing the method of the invention.

According to one variant of implementation of the method of the invention shown in FIG. 4, the additional heating CC is carried out by injecting a heat-transfer fluid S (gas or liquid) that is brought under pressure into contact with the rail B and, preferably, sprayed against the side faces of the latter.

Conversely, if it is necessary to cool the rail B, the tunnel D can be equipped with ventilation means and/or cooling or air conditioning means (heat pump, etc.).

Another variant not shown here could consist of passing the section R of rail through a sealed conduit containing a liquid or a gas at a constant temperature or indeed a fluid whose temperature acts on that of the rail in the desired manner (by cooling or heating the rail).

According to yet another variant not shown here, it is possible to position burners close to the rail, either in the open air or inside a closed or semi-open chamber in which the intermediate section R is heated as it moves in translation, being in contact with the flames.

A preferred mode of implementation of the method of the invention consists of continuously measuring the temperature Ti of the intermediate section over all or part of its length with a view to controlling its thermodynamic behavior and bringing it to a predetermined destressing temperature Tf at the attachment point F of the rail.

Figure 5:
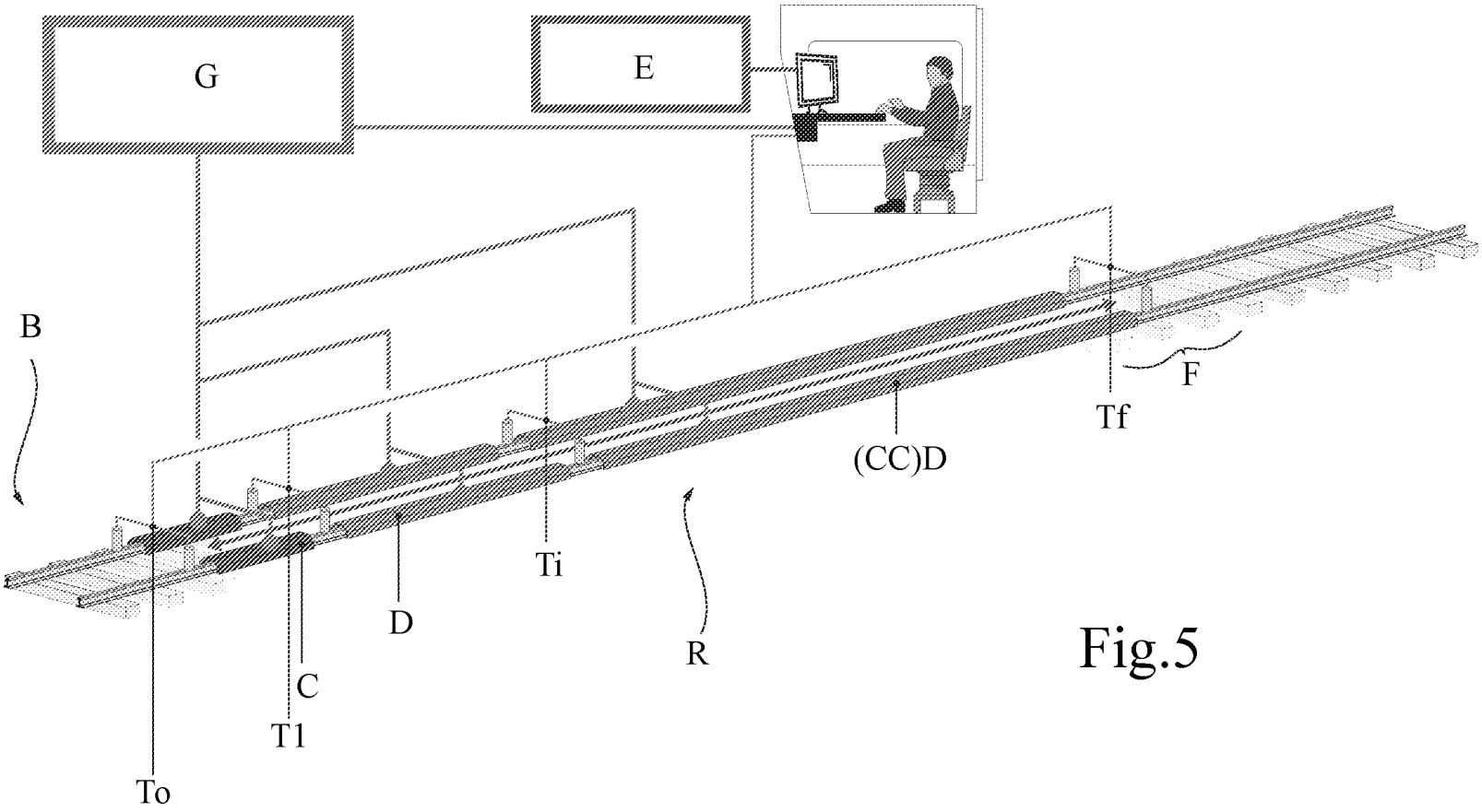
FIG. 5 is a synoptic diagram of an embodiment of the thermodynamic control of the rail according to the method of the invention.

To this end and as shown in FIG. 5, the method is implemented, in particular, by using a system G for controlling and managing the thermodynamic energy.

The system G comprises at least one sensor and, in this case, three sensors arranged on the intermediate section R, which are coupled to a computer E (and/or a microprocessor) acting on the primary adjustment means C and/or on the means for additional thermal treatment CC, whether the latter are passive or active.

Thus, any variation relative to the set temperature value Tf can be detected and corrected on the intermediate section R of the rail before the attachment area F.

In the variant shown in FIG. 5, a first sensor is arranged upstream from the primary adjustment means C to measure the initial temperature T0 of the new rail B, a second intermediate sensor is arranged to measure the temperature Ti along the section R and a third sensor is arranged to measure and confirm the destressing temperature Tf at the attachment point F.

If applicable, the energy management system G will also comprise a sensor or a tachometer positioned beyond the attachment area F to determine the forward speed of the train. This speed will be managed and/or controlled by the computer in order to better control the homogenization of the temperature along the section R.

All of the measurements taken by the different sensors are recorded in the memory of the computer E and contribute to the information contained in the database managed by the operator.

As shown in FIG. 5, it is possible, according to the method of the invention, to implement the thermodynamic control of the section R conjointly and simultaneously for the two parallel rails B of the same track.

The invention claimed is:

1. A railroad renewal method, comprising:

removing an old rail;

laying a new rail;

effecting a primary temperature adjustment by adjusting a temperature of the new rail at a primary temperature adjustment point located upstream from and close to an attachment area where the new rail is to be attached to a crosstie;

controlling a thermodynamic behavior of an intermediate section of the new rail located between the primary temperature adjustment point and the attachment area to cause a temperature of the new rail to be uniform, in a cross-section thereof, at a set value at the attachment point.

2. The method according to claim 1, which comprises thermodynamically controlling the intermediate section by thermally insulating the intermediate section from an environment.

3. The method according to claim 2, which comprises thermally insulating the intermediate section by at least one thermally insulated tunnel.

4. The method according to claim 1, which comprises carrying out the primary temperature adjustment by maintaining a temperature higher than the set value.

5. The method according to claim 1, which comprises carrying out an additional thermal treatment along the intermediate section to compensate for thermal interactions with the environment.

6. The method according to claim 5, which comprises continuously measuring the temperature of the intermediate section over all or part of a length thereof by at least one sensor coupled to a computer acting on the primary temperature adjustment and/or on the additional thermal treatment.

7. The method according to claim 5, which comprises carrying out the additional thermal treatment by way of a thermodynamic fluid.

8. The method according to claim 7, which comprises bringing the thermodynamic fluid, under pressure, into contact with the new rail.

9. The method according to claim 7, wherein the thermodynamic fluid is a heat-transfer fluid sprayed against faces of the new rail.

10. The method according to claim 5, which comprises carrying out the additional thermal treatment by contacting the intermediate section of the rail with a flame.

11. The method according to claim 1, which comprises carrying out the primary temperature adjustment of the intermediate section by heating with at least one induction system.

12. A railroad renewal device, comprising:

a primary temperature adjustment device for carrying out a primary adjustment of a temperature of a new rail upstream from and in close vicinity of an attachment area where the new rail is attached to a crosstie;

a system for controlling and managing a thermodynamic energy of the intermediate section of the new rail located between said primary adjustment device and the attachment area, said system being configured to cause a temperature of the new rail to be uniform at a set value at the attachment point.

13. The device according to claim 12, wherein said system comprises at least one device for additional thermal treatment along the section for compensating for heat exchanges with the environment.

14. The device according to claim 13, wherein said system comprises at least one temperature sensor disposed on the intermediate section, and wherein said sensor is coupled to a computer acting on said primary temperature adjustment device and/or on said device for additional thermal treatment.

15. The device according to claim 14, wherein said system comprises three temperature sensors that are arranged, respectively, at said primary temperature adjustment means, along the section and at the attachment area.

16. The device according to claim 13, wherein said at least one device for additional thermal treatment of the section comprises at least one thermally insulated tunnel.

17. The device according to claim 13, wherein said at least one device for additional thermal treatment of the section comprises a heating member that functions according to one or more modes selected from the group consisting of induction heating, heating by heat-transfer fluid or heating by contact with a flame.

18. The device according to claim 13, wherein said at least one device for additional thermal treatment of the section comprise a cooling member.

* * * * *